US008376809B2

(12) United States Patent
Kaito

(10) Patent No.: US 8,376,809 B2
(45) Date of Patent: Feb. 19, 2013

(54) CYLINDRICAL GRINDER AND CYLINDRICAL GRINDING METHOD OF INGOT

(75) Inventor: Ryoichi Kaito, Tokyo (JP)

(73) Assignee: Sumco Corporation, Tokyo (JP)

( * ) Notice: Subject to any disclaimer, the term of this patent is extended or adjusted under 35 U.S.C. 154(b) by 299 days.

(21) Appl. No.: 12/708,842

(22) Filed: Feb. 19, 2010

(65) Prior Publication Data

US 2010/0216375 A1 Aug. 26, 2010

(30) Foreign Application Priority Data

Feb. 25, 2009 (JP) ..... 2009-042888

(51) Int. Cl.
*B24B 1/00* (2006.01)

(52) U.S. Cl. ..... 451/41; 451/49; 451/142; 451/460

(58) Field of Classification Search ..... 451/41, 451/49, 51, 63, 160, 142, 242, 246, 385, 451/398, 460; 82/122; 409/165–168; 29/271, 29/281.1, 238, 281.5
See application file for complete search history.

(56) References Cited

U.S. PATENT DOCUMENTS 1,338,178 A * 4/1920 Henderson ..... 451/46
2,002,317 A * 5/1935 Hoke ..... 451/49
2,159,288 A * 5/1939 Morgan ..... 451/441
2,365,385 A * 12/1944 Booth ..... 451/385
2,436,928 A * 3/1948 Kempe ..... 123/188.3
2,622,373 A * 12/1952 Stahlecker et al. ..... 451/142
3,177,807 A * 4/1965 Rose et al. ..... 101/401.3
3,802,412 A * 4/1974 Lane ..... 125/13.02
4,211,040 A * 7/1980 Steudten et al. ..... 451/134
4,331,452 A * 5/1982 Causey et al. ..... 451/67
4,949,700 A * 8/1990 Ebashi ..... 125/13.01
4,951,422 A * 8/1990 Ibe et al. ..... 451/5
5,025,690 A * 6/1991 Myers ..... 82/121
5,525,092 A * 6/1996 Hirano et al. ..... 451/5
5,902,171 A 5/1999 Hamasaki
6,071,179 A * 6/2000 Sakai et al. ..... 451/50
6,322,424 B1 * 11/2001 Akagi ..... 451/28
6,497,765 B1 * 12/2002 Nice ..... 117/200
7,029,366 B2 * 4/2006 Montandon ..... 451/5
8,074,544 B2 * 12/2011 Nishino et al. ..... 82/122
2006/0174820 A1 * 8/2006 Yoshizawa ..... 117/13

FOREIGN PATENT DOCUMENTS

JP 11-291145 10/1999
JP 2001-259975 9/2001
JP 2008-200816 9/2008
JP 2009-190142 8/2009

* cited by examiner

*Primary Examiner* — George Nguyen
(74) *Attorney, Agent, or Firm* — Greenblum & Bernstein P.L.C.

(57) ABSTRACT

A cylindrical grinder is disclosed that includes a support unit including an upper support device and a lower support device, in which an ingot of silicon single crystal is interposed in a direction of axis line between the upper support device and the lower support device and is clampingly held to be rotated around the axis line, and a grinding unit that relatively moves along the direction of axis line of the ingot to traverse grind an outer circumference of the ingot. The upper support device is placed at an upper position and the lower support device is placed at a lower position, so that the support unit clampingly holds the ingot in a state in which the direction of the axis line of the ingot is disposed along a vertical direction.

9 Claims, 14 Drawing Sheets

CYLINDRICAL GRINDER AND CYLINDRICAL GRINDING METHOD OF INGOT

BACKGROUND OF THE INVENTION

1. Field of the Invention

The present invention relates to a cylindrical grinder and a cylindrical grinding method which can perform traverse grinding on an outer circumference of an ingot of silicon single crystal.

Priority is claimed on Japanese Patent Application No. 2009-042888, filed Feb. 25, 2009, the contents of which are incorporated herein by reference.

2. Description of Related Art

Previously, a wafer used in a semiconductor device has been manufactured by producing an ingot of silicon single crystal (crystal rod) by a Czochralski method (CZ method), traverse grinding an outer circumference of the ingot by a cylindrical grinder to finish the ingot to have a predetermined dimension (diameter), and slicing the ingot in a direction perpendicular to an axis line of the ingot.

For example, FIG. 18 shows one example of a cylindrical grinder A of a related art which traverse grinds the outer circumference of an ingot 1. The cylindrical grinder A includes a support unit 2 clamping the ingot 1 at both sides thereof in a direction of axis line O1 in a state in which the direction of the axis line O1 is disposed along a horizontal direction (a transverse direction T1) and clampingly holding the ingot 1 to rotate the ingot 1 around the axis line O1, and a grinding unit 3 disposed so as to be able to move in the direction of the axis line O1 of the ingot 1 (a horizontal direction, a transverse direction T1) grinding the outer circumference of the ingot 1 while moving in the direction of axis line O1. Such a related art is disclosed, for example, in Japanese Unexamined Patent Application Publication No. 2008-200816, Japanese Unexamined Patent Application Publication No. 2001-259975, and Japanese Unexamined Patent Application Publication No. Hei 11-291145.

The support unit 2 includes a pair of left and right support devices 4 and 5 for holding both end portions 1*a* and 1*b* side of the ingot 1 in a direction of axis line O1. The support device 4 has a main shaft (driving shaft) 4*a* rotating around a central axis line O2, for example, by driving of a motor or the like, and a holder 4*b* fixedly installed to a leading end portion of the main shaft 4*a* to hold one end portion 1*a* side of the ingot 1. The other support device 5 is installed to be freely rotated around a central axis line O3, and includes an auxiliary shaft (driven shaft) 5*a* installed to be moved in a direction of the central axis line O3, for example, by a hydraulic cylinder or the like, and a holder 5*b*, fixedly installed to a leading end of the auxiliary shaft 5*a*, for holding the other end portion 1*b* side of the ingot 1.

When the ingot 1 of silicon single crystal is traverse ground by using the cylindrical grinder A, firstly, the ingot 1 is set between the pair of left and right support devices 4 and 5 in a state in which the direction of axis line O1 is disposed along the transverse direction T1, and one end portion 1*a* side of the ingot 1 is mounted and held to the holder 4*b* of the one support device 4. In addition, the holder 5*b* is moved together with the auxiliary shaft 5*a* of the other support device 5 to be mounted on the other end 1*b* side of the ingot 1, so that the ingot 1 is clampingly held by the pair of left and right support devices 4 and 5.

When the main shaft 4*a* and the holder 4*b* of the one support device 4 are rotated, the ingot 1 is rotated around the axis line O1. The auxiliary shaft 5*a* and the holder 5*b* of the other support device 5 are rotatingly driven around the central axis line O3, so that the ingot 1 is rotated around the axis line O1, with the ingot 1 being clampingly held by the pair of left and right support devices 4 and 5.

A rotating grind stone 3*a* of the grinding unit 3 is pressed against the outer circumference of the ingot 1 which is rotated around the axis line O1, and the grinding unit 3 is moved in the transverse direction T1 along the direction of axis line O1 of the ingot 1 to sequentially grind the outer circumference of the ingot 1 and thus finish the ingot 1 to have a predetermined dimension (a diameter).

In order to manufacture more wafers from one ingot 1 and also manufacture a wafer of a large diameter such as a wafer of 450 mm in diameter, recently, the ingot 1 to be cylindrically ground has grown in size (increased in length and diameter) and in weight.

Since the cylindrical grinder A of the related art is adapted to clampingly hold the ingot 1 by using the support unit 2 (i.e., the pair of left and right support devices 4 and 5) in the state in which the direction of axis line O1 is disposed along the transverse direction T1, as shown in FIG. 19, there is a problem in that when the enlarged and weighted ingot 1 is cylindrically ground, deformation occurs in the ingot 1, and thus process precision is deteriorated.

Meanwhile, when the ingot 1 of silicon single crystal is produced, for example, by using the Czochralski method, a straight barrel portion 6 of a cylindrical rod shape is formed at a center portion in the direction of axis line O1, and a conical top portion 7 and a conical tail portion 8 are formed at both end portions 1*a* and 1*b* sides of the ingot 1 in the direction of axis line O1. For example, in the case in which it is necessary to cut a sample, when the ingot 1 is manufactured, there is a case in which a slip dislocation of the single crystal occurs in the tail portions 8. When generation of dislocation occurs in the tail portion 8, the top portion 7 or the tail portion 8 may be cut by using a band saw or the like prior to cylindrical grinding.

When the ingot 1 with the cut top portion 7 or the cut tail portion 8 is cylindrically ground, as shown in FIGS. 20 and 21, end faces 1*c* and 1*d* (1*a* and 1*b*) of the ingot 1 are clampingly held by the holders 4*b* and 5*b* of the pair of left and right support devices 4 and 5. In the cylindrical grinder A of the related art, since an acting direction of a clamping force F1 applied from the pair of left and right support devices 4 and 5 is perpendicular to an acting direction of the weight W1 of the ingot 1 itself and an acting direction of a process load W2 applied from the grinding unit 3, as the ingot 1 grows in size and in weight, slippage is likely to occur between the ingot 1 and the holders 4*b* and 5*b* of the support unit 2, so that positional deviation occurs in the ingot 1 to deteriorate the process precision.

Although it may be contemplated that strong clamping force F1 is applied to the ingot 1 to prevent the positional deviation of the ingot 1, a large-sized support unit 2 (the support devices 4 and 5) is necessary in this instance. In addition, in the case of cylindrically grinding the ingot 1 (dislocation occurring product) of which generation of dislocation occurs at the crystal of the tail portion 8, since compressive stress of the dislocation occurring crystal is weaker than that of the dislocation-free crystal, the ingot 1 may become damaged if the ingot 1 is held with the strong clamping force F1. For this reason, when the ingot 1 of the dislocation occurring product is ground by the cylindrical grinder A of the related art, it is necessary to cut the dislocation occurring portion of the tail portion 8 prior to the cylindrical grinding.

In addition, in the case where the ingot 1 is clampingly held in the state in which the direction of axis line O1 is disposed along the transverse direction T1, as shown in FIG. 18, while the ingot 1 is moved in a vertical direction T2 or a back and forth direction T3 (a transverse direction) in the state in which the direction of axis line O1 is disposed along the transverse direction T1, it is necessary to perform centering by coinciding the axis line O1 of the ingot 1 with the central axis lines O2 and O3 of the main shaft 4*a* and the auxiliary shaft 5*a* of the support devices 4 and 5 (i.e., placing them substantially coaxially). Further, when the ingot is clampingly held by the pair of left and right support devices 4 and 5, the axis line O1 of the ingot 1 may be deviated. In this instance, after the clampingly held state is released for a while, it is necessary to correct the centering by moving again the ingot 1 in the vertical direction T2 or back and forth direction T3. Therefore, in the cylindrical grinder A of the related art which clampingly holds the ingot 1 in the state in which the direction of axis line O1 is disposed along the transverse direction T1, there is a problem that a lot of manpower is required for the centering (or correction of the centering).

For example, as disclosed in Japanese Unexamined Patent Application Publication No. 2009-190142, a cylindrical grinding method has been known in which a cylindrical block formed by cutting an ingot to be short is vertically placed and then an outer circumference thereof is ground. However, this method requires a process of cutting and removing a top portion and a tail portion and cutting again the ingot in several blocks of a cylindrical shape. In addition, a long time is required when the ingot with the top portion and the tail portion removed is positioned, thereby deteriorating productivity.

SUMMARY OF THE INVENTION

In view of the foregoing state of the art, it is an object of the present invention to provide a cylindrical grinder and a cylindrical grinding method which can easily position an ingot, easily perform centering, and reliably prevent positional deviation of the ingot in order to improve process precision.

In order to achieve the above object, the invention provides the following means.

According to a first aspect of the invention, there is provided a cylindrical grinder including: a support unit including an upper support device and a lower support device, in which an ingot of silicon single crystal is interposed in a direction of an axis line between the upper support device and the lower support device and is clampingly held to be rotated around the axis line; and a grinding unit that relatively moves along the direction of an axis line of the ingot to traverse grind an outer circumference of the ingot, wherein the upper support device is placed at an upper position and the lower support device is placed at a lower position, so that the support unit clampingly holds the ingot in a state in which the direction of the axis line faces a vertical direction.

According to a second aspect of the invention, there is provided a cylindrical grinding method of an ingot including the steps of: holding an ingot of silicon single crystal in a direction of axis line by a support unit, and rotating the ingot around the axis line, and relatively moving a grinding unit along the direction of axis line of the ingot to traverse grind an outer circumference of the ingot, wherein the ingot is clampingly held by the support unit in a state in which the direction of the axis line of the ingot is disposed along a vertical direction, and the grinding unit is relatively moved along the direction of the axis line of the ingot of the vertical direction to perform the traverse grinding.

According to the first aspect and the second aspect, since the support unit is adapted to clampingly hold the ingot in the state in which the direction of the axis line is disposed along the vertical direction, the weight W1 of the ingot 1 acts in the direction of axis line, so that the acting direction of the weight of the ingot may be identical to the acting direction of the clamping force which clampingly holds the ingot by the pair of upper and lower support devices of the support unit. For this reason, when the ingot is clampingly held by the upper and lower supporting device, the ingot is not deformed by the weight, thereby enhancing the process precision, compared with the cylindrical grinder of the related art (the cylindrical grinding method of the related art).

The own weight of the ingot itself is supported by the lower support device in the state in which the ingot is clampingly held. Therefore, even though the clamping force applied to the ingot from the upper support device is set to be weak, the ingot can be clampingly held in a stable state.

That is, in the case in which the ingot is clampingly held in the state in which the direction of an axis line is disposed along the vertical direction, since the ingot is set on the lower support device, the lower end portion side of the ingot 1 is firmly supported on the lower support device by the weight of the ingot itself, so that the lower end portion (one end portion) side of the ingot is not deviated. In the case in which the ingot is applied with the process load from the grinding unit in a transverse direction, strong resistance is generated between the lower support device and the lower end portion side of the ingot by the weight of the ingot itself, so that the lower end portion side of the ingot is similarly not deviated.

Meanwhile, the positional deviation of the upper end portion (the other end portion) side of the ingot can be prevented by applying the weak clamping force to the ingot from the upper support device, wherein the clamping force being set to a level to resist the process load in the transverse direction generated when the outer circumference of the upper end portion side of the ingot is ground by the grinding unit. For this reason, even though the clamping force is set to be weak, the positional deviation does not occur between the ingot and the pair of upper and lower support devices, thereby reliably improving the process precision.

When the ingot is clampingly held between the pair of upper and lower support devices, it is possible to perform the centering by setting the ingot on the lower support device and moving the ingot in a transverse direction. Therefore, unlike the cylindrical grinder of the related art which clampingly holds the ingot in the state in which the direction of axis line is disposed along the transverse direction, it is not necessary to perform the centering (or correction of the centering) by moving the ingot in the vertical direction or back and forth direction, thereby making it possible to perform the centering easily.

In the cylindrical grinder according to the first aspect of the invention, each of the upper support device and the lower support device includes a holder for holding an end portion side of the ingot in the direction of the axis line, and the holder may be provided with a conical engaging hole with a diameter which is gradually decreased from one surface facing the ingot side to the other surface with a central axis of the holder as a center.

In the case in which the ingot has a conical top portion and a conical tail portion at both end portions in the direction of the axis line, the top portion and the tail portion are engaged to the conical engaging holes formed in the holders of the upper support device and the lower support device, so that the end portions side of the ingot can be easily and reliably held without the occurrence of positional deviation. Since the conical top portion and the conical tail portion are engaged to the conical holes, the axis line of the ingot and the central axis lines of the support devices are automatically coaxially placed, thereby easily performing the centering. In the case of the ingot with the cut top portion and the cut tail portion, it is possible to hold the end portion side of the ingot by abutting the cut surface (end face) of the ingot on the one surface of the holder with the engaging hole opened.

In the cylindrical grinder, the engaging hole may be formed to penetrate the holder from the one surface to the other surface.

In this case, since the engaging hole of the holder of the lower support device is formed to penetrate the holder from one surface to the other surface (from the top surface to the bottom surface), if the grinding dust generated when the outer circumference of the ingot is ground enters into the engaging hole of the holder of the lower support device, it is possible to discharge the grinding dust outwardly from the opening of the other surface (the bottom surface). Since the engaging hole in the holder of the upper support device is formed to penetrate the holder from one surface to the other surface (from the bottom surface to the top surface), the ingot sensing rod can be inserted and mounted into the engaging hole from the other surface (the top surface) through this opening of the other surface (the top surface). For this reason, when the upper end portion side of the ingot is clampingly held by moving the holder of the upper support device, the ingot can be sensed by the ingot sensing rod. Therefore, it is possible to clampingly hold the ingot appropriately by reliably applying the predetermined clamping force to the ingot so as not to create the positional deviation. When the lower end portion side of the ingot is held by the holder of the lower support device with inserting and mounting the ingot sensing rod into the engaging hole of the lower holder, the lower end portion side of the ingot may be sensed.

The cylindrical grinder may include a positioning means for positioning the ingot at a predetermined position by pressing the ingot which is interposed between the upper support device and the lower support device, in a horizontal direction.

In this instance, it is possible to move the ingot to a predetermined position, in which the axis line of the ingot and the central axis lines of the support devices are substantially coaxially placed, by placing the ingot on the lower support device and then pressing the ingot placed between the pair of upper and lower support devices in the transverse direction by using the positioning means. In addition, since the movement of the ingot in the horizontal direction is restricted by engaging the top portion of the ingot to the conical engaging hole formed in the holder of the lower support device, the slippage of the ingot in the horizontal direction is suppressed, and thus the positioning of the ingot can be easily performed. As a result, the centering can be easily performed by the positioning means.

In the cylindrical grinding method of the ingot according to the second aspect of the invention, a top portion side of the ingot which is firstly formed when the ingot is produced by growing the silicon single crystal may be placed at a lower position, and the ingot may be clampingly held by the support unit.

In this instance, the top portion side of the ingot is placed at a lower position, and the tail portion side is placed at an upper position, so that the ingot is clampingly held. It is possible to clampingly hold the ingot by applying the strong compressive force to the top portion side due to the weight of the ingot itself and applying the weak clamping force on the tail portion side. Therefore, in the case in which generation of dislocation occurs at the tail portion of the ingot, it is possible to clampingly hold the ingot appropriately by reliably preventing the tail portion side from being damaged without applying the strong compressive force, which is generated due to the weight of the ingot itself, on the tail portion side which is vulnerable to the compressive force. As a result, it is possible to perform the cylindrical grinding without cutting the dislocation occurring portion of the tail portion prior to the cylindrical grinding.

With the cylindrical grinder according to the first aspect of the invention and the cylindrical grinding method of the ingot according to the second aspect of the invention, since the ingot is clampingly held in the state in which the direction of axis line is disposed along the vertical direction, in the case of performing the cylindrical grinding on the enlarged and weighted ingot, the ingot is not deformed, and the positional deviation does not occur even though a weak clamping force is applied to the ingot, thereby reliably improving the process precision.

In particular, when the ingot of which the top portion and the tail portion are removed is placed on the support unit (when the ingot is clampingly held), it is possible to easily perform the centering (correction of the centering) by placing the ingot on the lower support device and then moving the ingot in the transverse direction.

DETAILED DESCRIPTION OF THE INVENTION

A cylindrical grinder and a cylindrical grinding method of an ingot according to an embodiment of the invention will now be described with reference to FIGS. 1 to 8. The embodiment relates to a cylindrical grinder and a cylindrical grinding method of an ingot used when an outer circumference of the ingot of silicon single crystal manufactured by a Czochralski method is subjected to traverse grinding.

Figure 1:
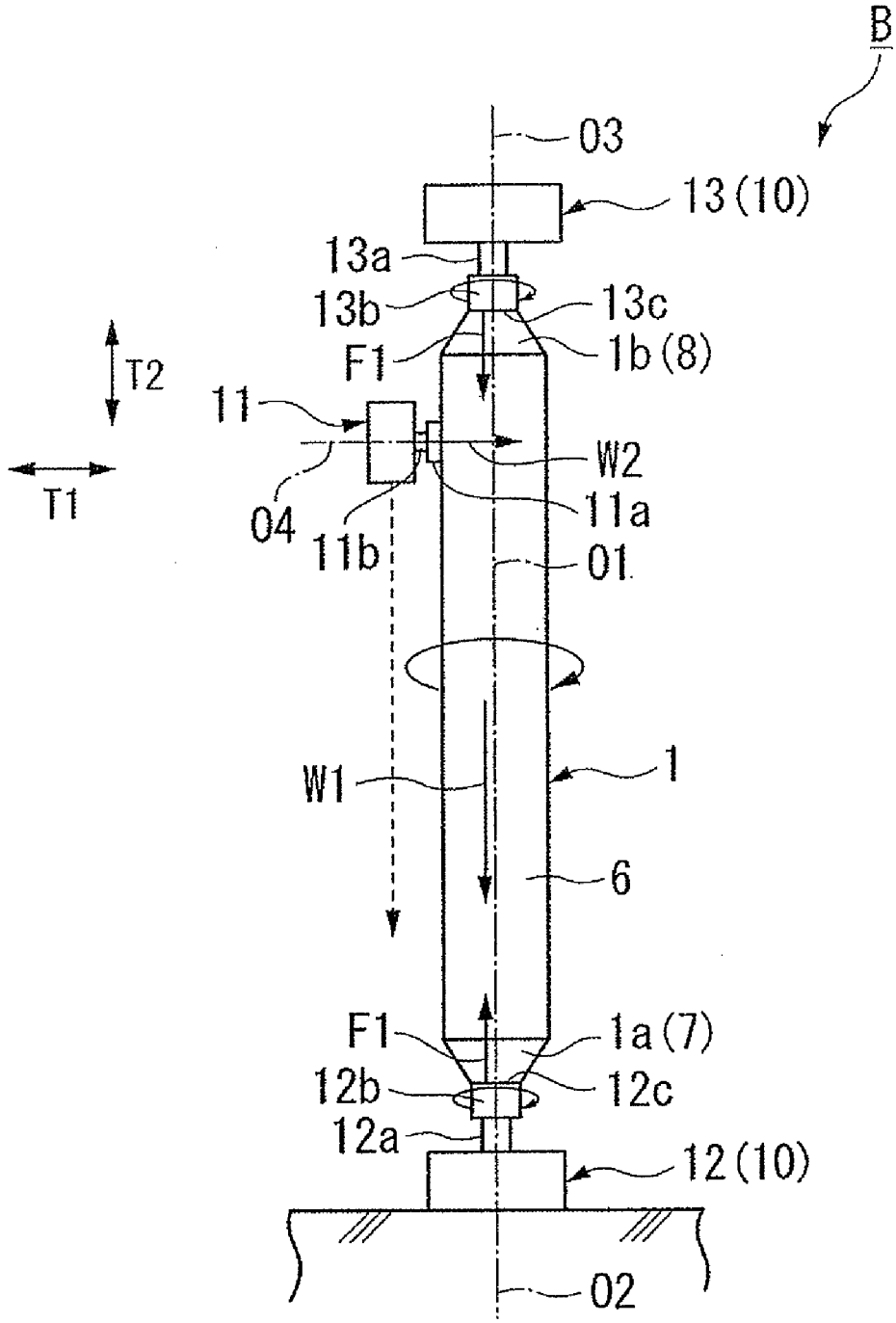
FIG. 1 is a front view illustrating a cylindrical grinder according to an embodiment of the invention to show a state in which an ingot (dislocation-free product) having a top portion and a tail portion is clampingly held.

A cylindrical grinder B of this embodiment includes, as shown in FIG. 1, a support unit 10 clamping an ingot 1 in a direction of axis line O1 and clampingly holding the ingot to rotate the ingot around the axis line O1, and a grinding unit 11 for traverse grinding the outer circumference of the ingot 1 while moving in the direction of axis line O1 of the ingot 1.

The support unit 10 includes a pair of a lower support device 12 and an upper support device 13 which clampingly hold both end portions 1*a* and 1*b* sides of the ingot 1 in the direction of axis line O1. The lower support device 12 has a main shaft (driving shaft) 12*a* rotating around a central axis line O2, for example, by driving of a motor or the like, and a holder 12*b* fixedly installed to a leading end portion of the main shaft 12*a* to hold one end portion (lower end portion 1*a*) side of the ingot 1. The upper support device 13 has an auxiliary shaft (driven shaft) 13*a* installed to freely rotate around a central axis line O3 and being movable back and forth in the direction of the central axis line O3, for example, by a hydraulic cylinder, and a holder 13*b* fixedly installed to a leading end portion of the auxiliary shaft 13*a* to hold the other end portion (upper end portion 1*b*) side of the ingot 1.

According to the support unit 10, the pair of the lower and upper support devices 12 and 13 are placed in such a way that the central axis lines O2 and O3 are positioned on the same axis and surfaces 12*c* and 13*c* of the holders 12*b* and 13*b* are opposite to each other at a predetermined interval in an upper and lower direction (vertical direction) T2. In this instance, the lower support device 12 is fixedly installed on, for example, a floor surface, and the upper support device 13 is supported by an appropriate means, and is set at a predetermined position upward.

Figure 2:
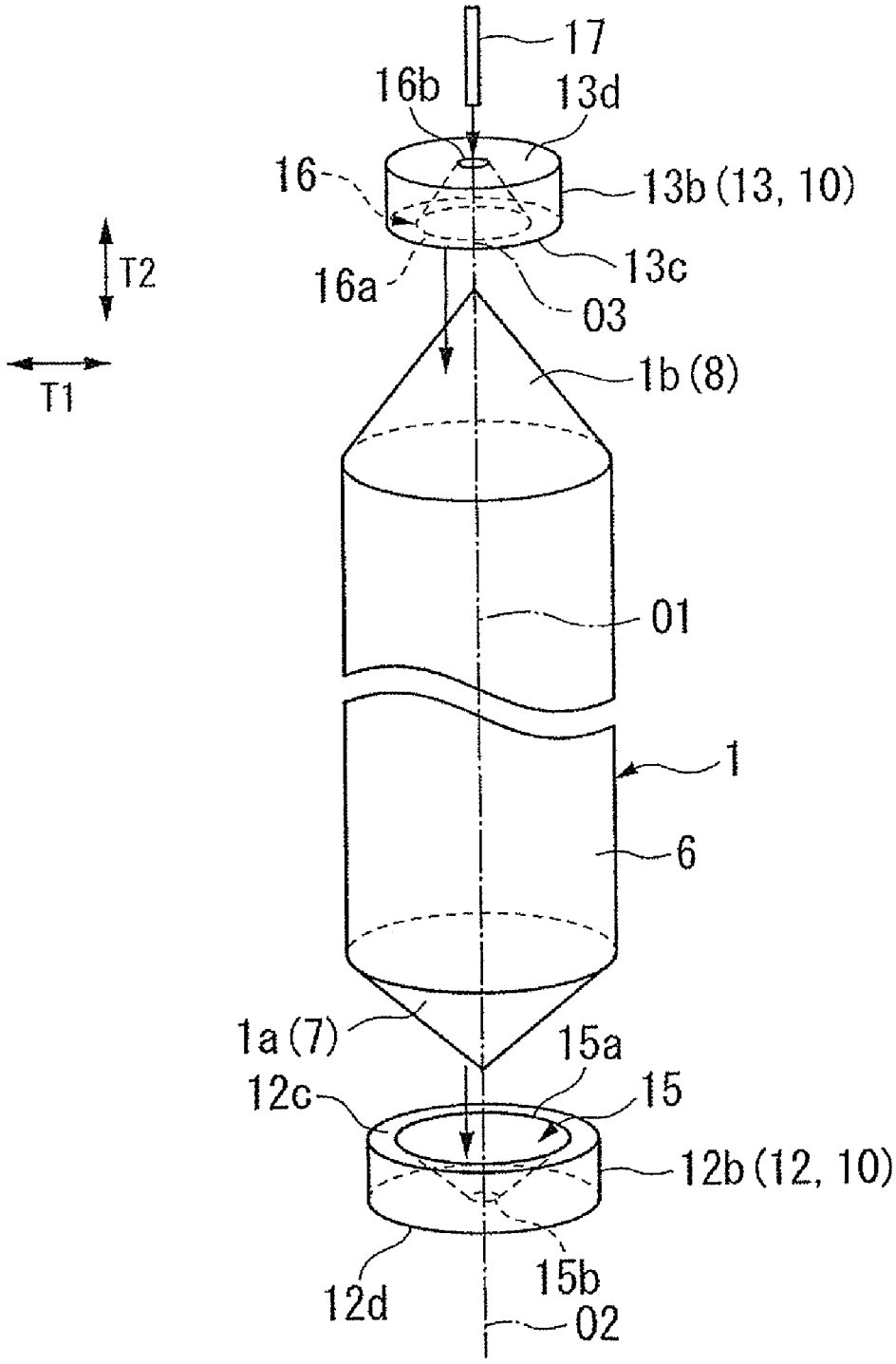
FIG. 2 is a perspective view illustrating a holder of a cylindrical grinder according to an embodiment of the invention to show a state in which the holder is mounted on an end portion of the ingot shown in FIG. 1.

In addition, as shown in FIG. 2, the holder 12*b* of the lower support device 12 is formed in a disc shape, and is provided with a conical engaging hole 15 with a diameter which is gradually decreased from a top surface 12*c* to a bottom surface 12*d* side (from one side facing the ingot side to the other surface side) with the central axis line O2 as a center. The holder 13*b* of the upper support device 13 is formed in a disc shape, similar to the holder 12*b* of the lower support device 12, and is provided with a conical engaging hole 16 with a diameter which is gradually decreased from a bottom surface 13*c* to a top surface 13*d* side (from one surface facing the ingot side to the other surface side) with the central axis line O3 as a center.

Figure 9:
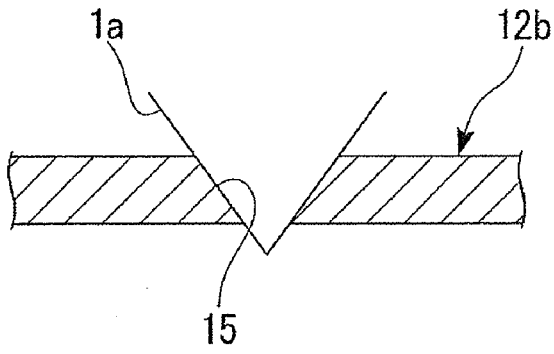
FIGS. 9 to 14 are longitudinal-sectional views illustrating a support structure of an end portion of an ingot using a holder.
Figure 10:
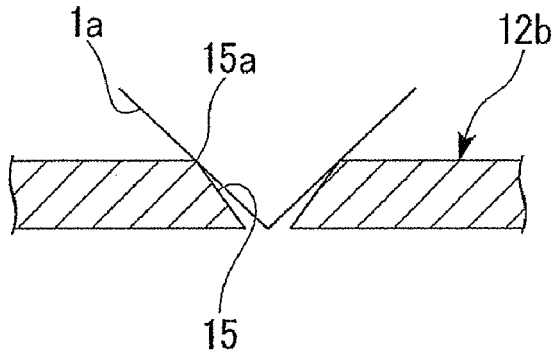
Figure 11:
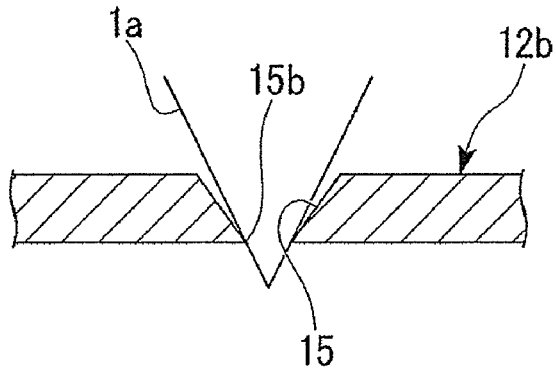

There is no special limit to a tapered angle of the engaging hole 15, but, as shown in FIG. 9, it is preferable that the engaging hole 15 has the same tapered angle in such a way that a contact area between the inner surface of the engaging hole and the ingot is increased. In this instance, there is a merit of stabilizing support of the ingot. As shown in FIG. 10, an end portion of the ingot may come in contact with an inner edge portion of an opening 15*a*, otherwise, as shown in FIG. 11, the ingot may come in contact with an inner edge portion of an opening 15*b* with a small diameter. As shown in FIG. 10, it is preferable that the ingot is supported not at the near side of the end portion thereof but at the near side of the straight barrel portion, since the contact area between the holder and the ingot is increased, so that the weight of the ingot itself per unit contact area is decreased.

Figure 12:
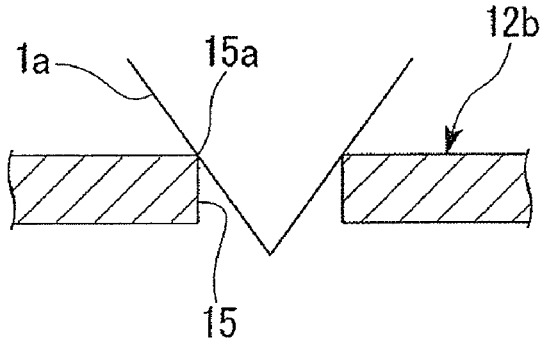
Figure 13:
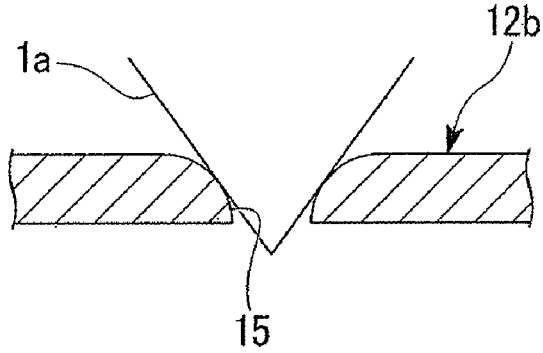
Figure 14:
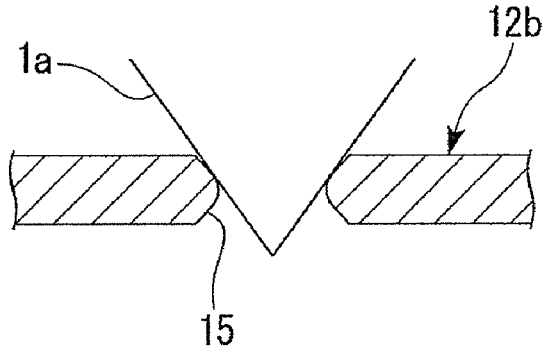

There is no special limit to the shape of the conical engaging hole 15 which is shown in FIG. 2, and the engaging hole 15 may be formed in a cylindrical shape as shown in FIG. 12. In this instance, the end portion of the ingot comes in contact with the inner edge portion of the opening 15*a*. In addition, as shown in FIG. 13, a contact step portion of the opening 15*a* may be formed in a round shape, otherwise, as shown in FIG. 14, the contact step portion may be formed in a hemispherical convex surface or a convex curved surface. It is preferable that the contact step portion is formed in the round shape, since the contact area between the ingot and the holder is increased, so that the weight of the ingot itself per unit contact area is decreased.

Figure 7:
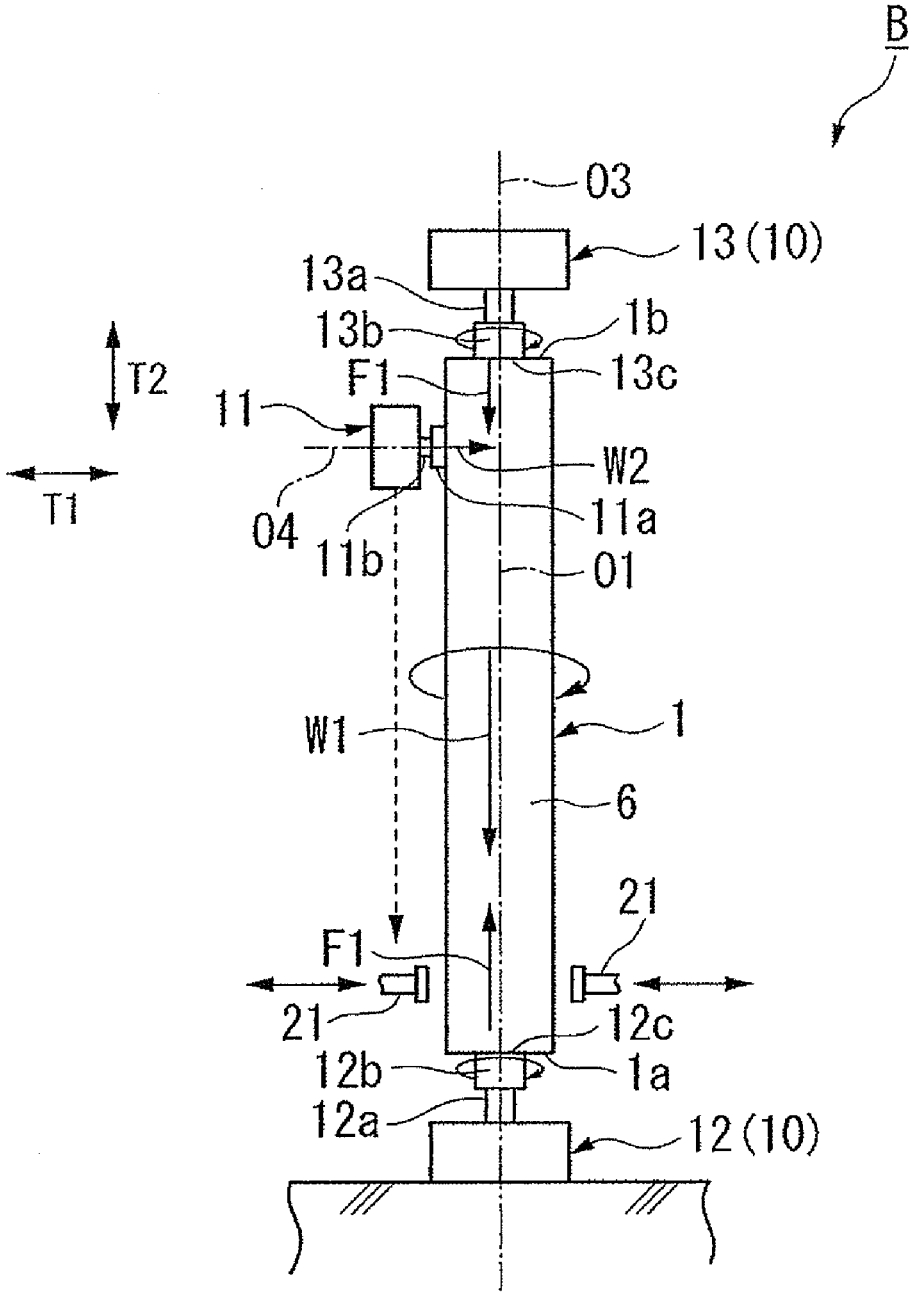
FIG. 7 is a front view illustrating a cylindrical grinder according to an embodiment of the invention to show a state in which an ingot with a cut top portion and a cut tail portion (top and tail portions-cut product) is clampingly held.
Figure 8:
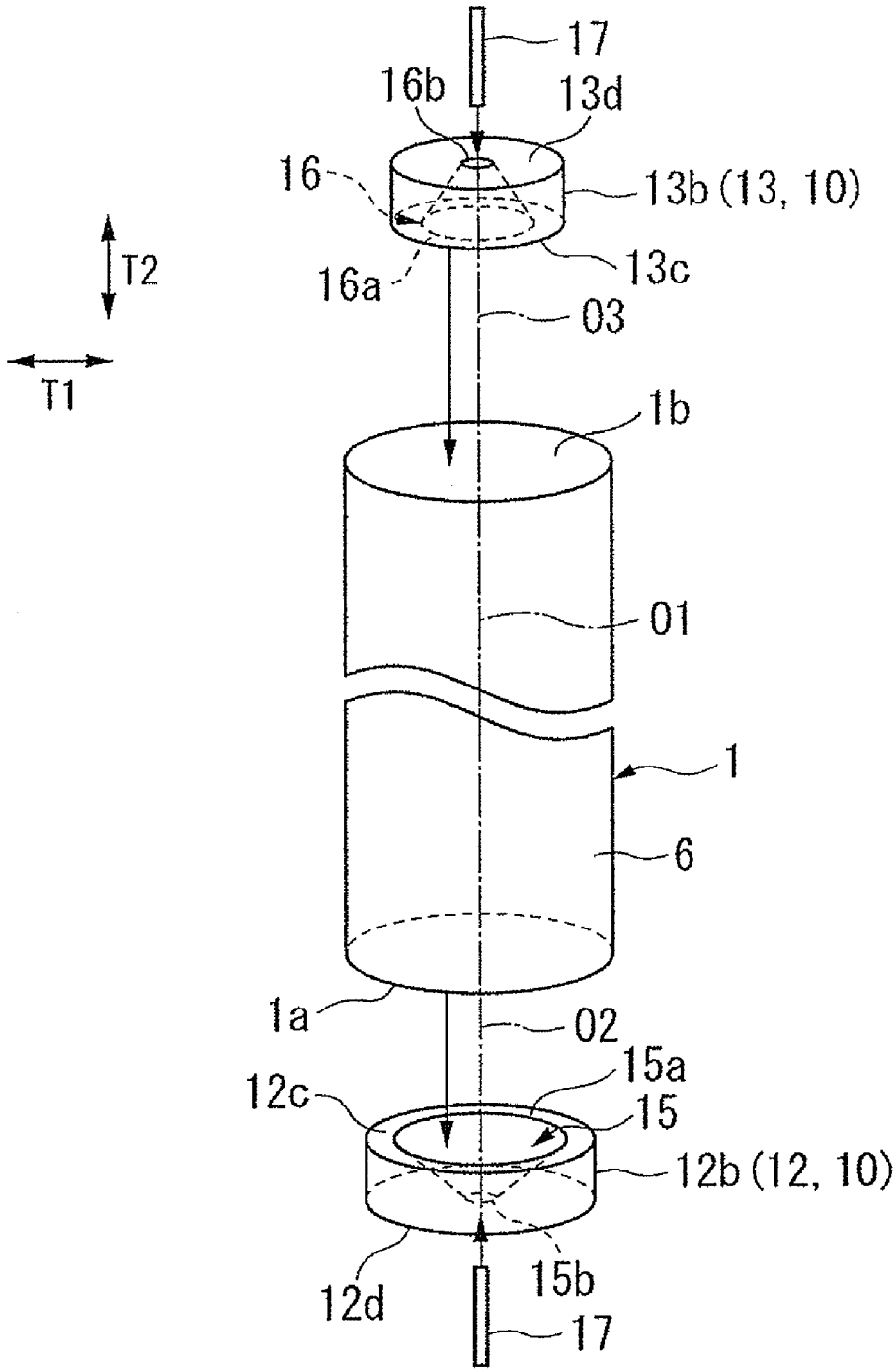
FIG. 8 is a perspective view illustrating a state in which a holder is mounted on an end portion of the ingot shown in FIG. 7.

There is no special limit to the material of the holder 12*b*, but it is preferable that the material of the holder has a high strength and an appropriate surface roughness. If the top surface 12*c* of the holder 12*b* is too smooth, as shown in FIGS. 7 and 8, in the case where a side surface of the ingot is pressed by the cylindrical grinder when the flat surface of the ingot is placed on the holder 12*b* for grinding, the ingot may be shifted in a horizontal direction to cause the positional deviation. It is possible to prevent positional deviation by allowing at least the top surface 12*c* to have an appropriate surface roughness. More specifically, at least the top surface 12*c* has a maximum roughness (Rmax) of about 2 to 10 μm.

Figure 17:
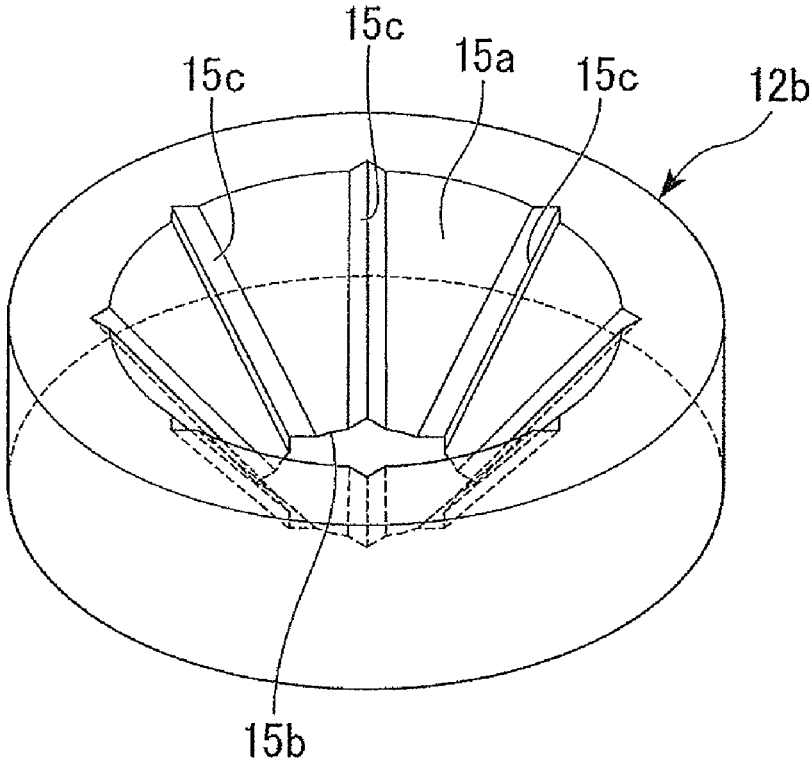
FIG. 17 is a perspective view illustrating a shape of a holder with a groove formed on an inner surface of an engaging hole according to an embodiment of the invention.
Figure 18:
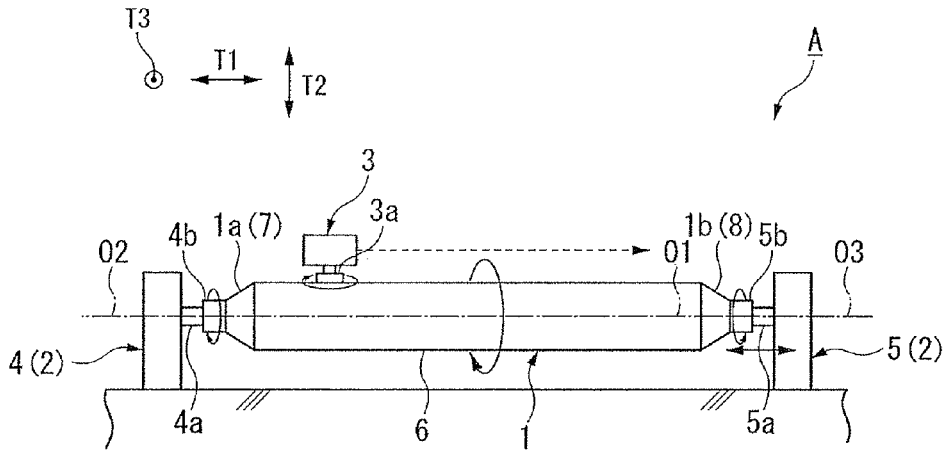
FIG. 18 is a front view illustrating a cylindrical grinder of related art to show a state in which an ingot (dislocation-free product) having a top portion and a tail portion are clampingly held.
Figure 19:
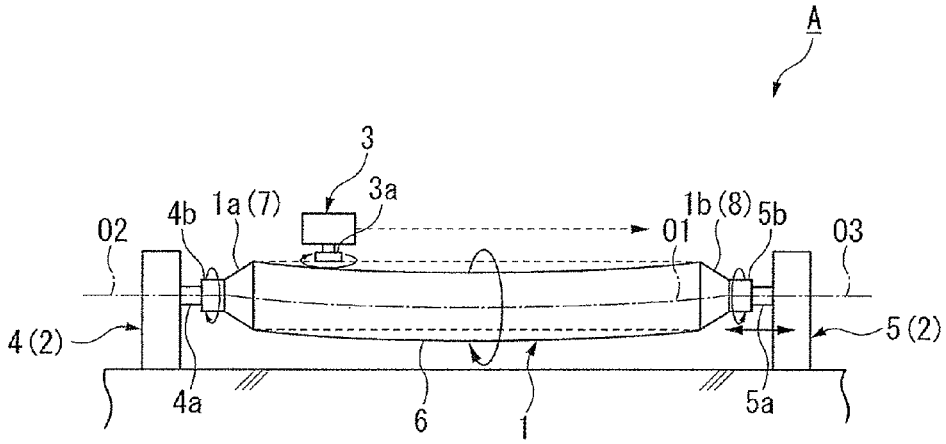
FIG. 19 is a front view illustrating a cylindrical grinder of related art to show a state in which deformation occurs in a clampingly held ingot.
Figure 20:
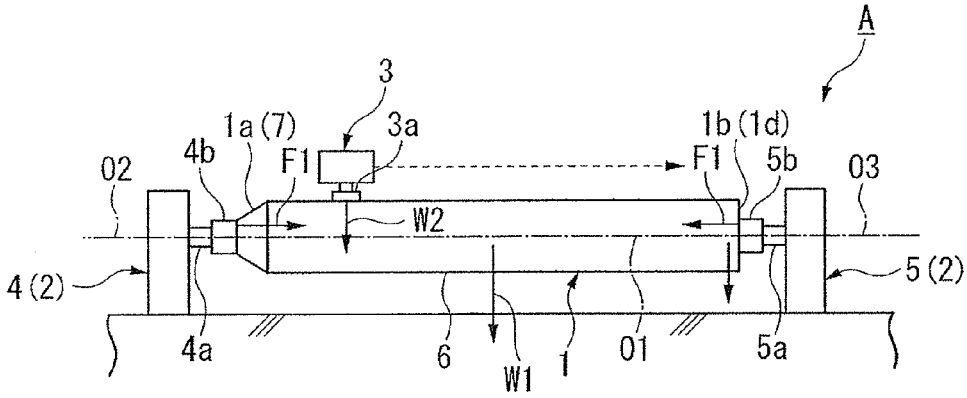
FIG. 20 is a front view illustrating a cylindrical grinder of related art to show a state in which an ingot with a cut tail portion (tail portion-cut product) is clampingly held.
Figure 21:
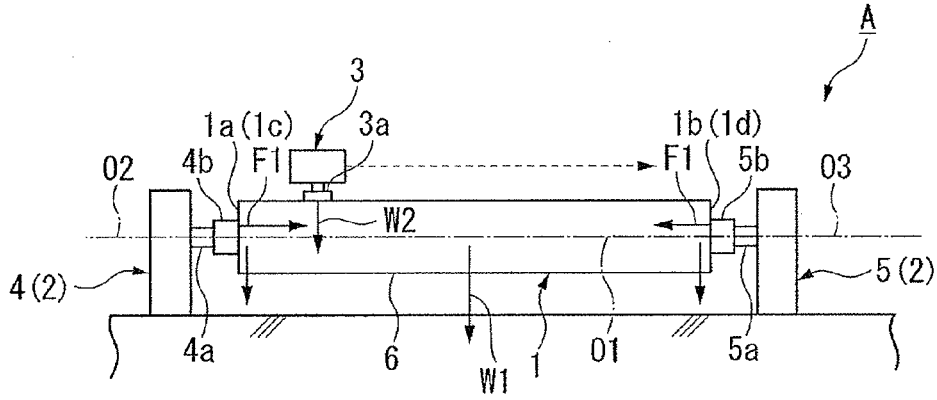
FIG. 21 is a front view illustrating a cylindrical grinder of related art to show a state in which an ingot with a cut top portion and a cut tail portion (top and tail portions-cut product) are clampingly held.

The engaging hole of the holder 12*b* may be provided on the inner surface of the engaging hole thereof with a plurality of grooves 15*c* of a radiated shape, as shown in FIG. 17. It is preferable that the grooves 15*c* are consecutively extended from the opening 15*a* to the small-diameter opening 15*b*. There is no special limit to the shape of the cross section of the groove 15*c*, but the groove may be formed in a U shape or V shape. There is no special limit to the number and depth of the grooves 15*c*. There is no special limit to the shape of the groove 15*c*, but the groove may be formed in a straight shape or in a spiral shape. By providing the engaging hole with the grooves 15*c*, it is possible to effectively discharge grinding dust outwardly. Further, a suction device may be installed at the outside of the small-diameter opening 15*b* to suck the grinding dust, thereby making it easier to discharge the dust outwardly.

In this embodiment, the holder 12*b* of the lower support device 12 is provided with the engaging hole 15 penetrating the holder from the top surface 12*c* to the bottom surface 12*d*, so that the large-diameter opening 15*a* is formed in the top surface 12*c* and the small-diameter opening 15*b* is formed in the bottom surface 12*d*. The holder 13*b* of the upper support device 13 is provided with the engaging hole 16 penetrating the holder from the bottom surface 13*c* to the top surface 13*d*, so that the large-diameter opening 16*a* is formed in the bottom surface 13*c* and the small-diameter opening 16*b* is formed in the top surface 13*d*. The engaging holes 15 and 16 formed in the respective holders 12*b* and 13*b* of the pair of lower and upper support devices 12 and 13 are formed in such a way that the diameter of the small-diameter openings 15*b* and 16*b* is about 40 mm.

Meanwhile, the grinding unit 11 includes, as shown in FIG. 1, a disc-shaped grind stone 11*a* which is coaxially attached to a leading end portion of a rotational shaft 11*b* rotating around its axis line, for example, by a motor or the like. The grind stone 11*a* can be moved between the pair of the lower and upper support devices 12 and 13 in a vertical direction T2 (upper and lower direction), and the rotational shaft 11*b* (grind stone 11*a*) can be moved back and forth in the direction of the rotational axis line O4. The grinding unit 11 is set in such a way that the rotation axis line O4 of the rotational shaft 11*b* is perpendicular to the central axis lines O2 and O3 of the pair of lower and upper support devices 12 and 13 and the grind stone 11*a* is disposed facing the central axis lines O2 and O3 of the pair of lower and upper support devices 12 and 13.

Next, a method of traverse grinding of the ingot 1 by using the cylindrical grinder B with the above-described configuration according to the embodiment will be described, and the function and effect of the cylindrical grinder B and the cylindrical grinding method of the ingot 1 according to the embodiment will be described. Movement of the grinding unit 11 may be either a one-way movement or a reciprocating movement, and reciprocation times are not limited.

When the outer circumference of the ingot 1 is ground by using the cylindrical grinder B according to the embodiment, at first, the ingot 1 is transferred and set between the pair of lower and upper support devices 12 and 13, with the direction of the axis line O1 of the ingot 1 facing the vertical direction T2 (i.e., in the state in which the ingot 1 stands upright). With this, the ingot 1 is placed on the holder 12*b* of the lower support device 12.

In this embodiment, as shown in FIGS. 1 and 2, the top portion 7 side (one end portion 1*a* side) of the ingot 1, which is initially formed when the ingot 1 is produced by growing silicon single crystal with a Czochralski method or the like, is placed at a lower position, the ingot 1 stands upright in the vertical direction T2, and then is set in such a way that the top portion 7 side is held by the holder 12*b* of the lower support device 12. The ingot 1 including the conical top portion 7 and the conical tail portion 8 which are formed at both end portions 1*a* and 1*b* side (both end sides of the straight barrel portion 6 of a cylindrical rod shape) in the direction of axis line O1 of the ingot 1 is set on the holder 12*b* of the lower support device 12, and the conical top portion 7 is engaged to the conical engaging hole 15 of the holder 12*b*, so that one end portion (the lower end portion) 1*a* side of the top portion 7 side is held by the holder 12*b*. One end portion 1*a* side of the top portion 7 side is firmly held on the lower support device 12 by the weight of the ingot itself. In addition, since the conical top portion 7 is engaged to the conical engaging hole 15, the axis line O1 of the ingot 1 and the central axis line O2 of the lower support device 12 are automatically and coaxially placed.

Next, at the step in which the ingot 1 is set on the holder 12*b* of the lower support device 12 and the one end portion 1*a* side of the top portion 7 side of the ingot 1 is held, the conical tail portion 8 is engaged to the conical engaging hole 16 of the holder 13*b* by moving the holder 13*b* of the upper support device 13 in a downward direction. The holder 13*b* of the upper support device 13 is moved in a downward direction so as to apply a predetermined clamping force (pressing force) F1 to the other end portion (upper end portion) 1*b* side of the tail portion 8 side of the ingot 1 which is engaged to the engaging hole 16, so that the ingot 1 is clampingly held by the pair of lower and upper support devices 12 and 13. The other end portion 1*b* side of the tail portion 8 is held at the holder 13*b* by engaging the conical tail portion 8 to the conical engaging hole 16 of the holder 13*b*, and the axis line O1 of the ingot 1 and the central axis lines O2 and O3 of the pair of lower and upper support device 12 and 13 are automatically coaxially placed, thereby easily and surely performing centering. Consequently, the ingot 1 is reliably clampingly held by the support unit 10 in the state in which the direction of the axis line O1 is disposed along the vertical direction T2.

Since the ingot 1 is clampingly held in the state in which the direction of the axis line O1 is disposed along the vertical direction T2, the weight W1 of the ingot 1 itself acts in the direction of the axis line O1, and the acting direction of the weight W1 of the ingot 1 itself is identical (the same vertical direction T2) to the acting direction of the clamping force F1 to clampingly hold the ingot 1 by the pair of lower and upper support devices 12 and 13 of the support unit 10. For this reason, for example, in the case in which an enlarged (increased in length and diameter) and weighted ingot 1 is clampingly held, the ingot 1 is not deformed due to the weight W1.

In addition, in the state of clampingly holding the ingot 1, the weight (compressive force) W1 of the ingot 1 itself is supported by the lower support device 12. For this reason, even if the clamping force F1 applied to the ingot 1 from the upper support device 13 is decreased, the ingot 1 is clampingly held in a reliably stable state. In this embodiment, the top portion 7 side is placed at a lower position, the tail portion 8 side is placed at an upper position, the strong compressive force is allowed to act on the top portion 7 side by the weight W1 of the ingot 1 itself, and the weak clamping force F1 is allowed to act on the tail portion 8 side, thereby clampingly holding the ingot 1. Therefore, in the case in which dislocation occurs at the tail portion 8 of the ingot 1, the strong compressive force by the weight W1 of the ingot 1 itself does not act on the tail portion 8 side which is vulnerable to compressive stress. Since the clamping force F1 acting on the tail portion 8 side may be weak, the ingot 1 (the tail portion 8 side) may not become damaged. Consequently, even if the dislocation occurring portion of the tail portion 8 is not cut, the grinding process can be advantageously performed.

In this embodiment, since the engaging hole 16 formed in the holder 13*b* of the upper support device 13 penetrates the holder from the bottom surface 13*c* to the top surface 13*d*, the ingot sensing rod 17 is inserted into the engaging hole 16 through the small-diameter opening 16*b* from the top surface 13*d* side of the holder 13*b*, so that the ingot sensing rod 17 can be mounted on the holder 13*b*. For this reason, when the holder 13*b* of the upper support device 13 is moved downward and the other end portion 1*b* side of the tail portion 8 side of the ingot 1 is clampingly held by the holder 13*b*, the leading end portion of the ingot sensing rod 17 abuts on the other end portion 1*b* side to sense the ingot 1. Therefore, it is possible to stop the movement of the holder 13*b* at the step in which the predetermined clamping force F1 is applied, so that the ingot 1 is clampingly held properly by applying the predetermined clamping force F1 to the ingot.

As described above, at the step in which the ingot 1 is clampingly held by the support unit 10, for example, the motor of the lower support device 12 is driven, and thus the main shaft 12*a* and the holder 12*b* are rotated around the central axis line O2. Consequently, the auxiliary shaft 13*a* and the holder 13*b* of the upper support device 13 are driven and rotated around the central axis line O3, and thus the ingot 1 clampingly held by the pair of lower and upper support devices 12 and 13 is rotated around the axis line O1. There is no special limit to a means for rotating the ingot 1, but the upper support device 13 may be further provided with a motor as well as the motor of the lower support device 12. In this way, the upper and lower motors may be interactively driven to rotate the ingot.

At the step of rotating the ingot 1, the grind stone 11*a* of the grinding unit 11 is rotated, and the grind stone 11*a* is moved ahead in the direction of the rotational axis line O4 to press the outer circumference of the ingot 1. With this, the grinding unit 11 is moved in the vertical direction T2 following the direction of the axis line O1 of the ingot 1 from the upper side of the straight barrel portion 6 of the ingot 1 to the lower side, so that the outer circumference of the ingot 1 is sequentially traverse ground.

In this instance, since the acting direction of the weight W1 of the ingot 1 itself and the acting direction of the clamping force F1 by the pair of lower and upper support devices 12 and 13 are identical to each other and thus the ingot 1 is not deformed by the weight, the outer circumference of the ingot 1 is ground with high precision by the grinding unit 11 to have the desired dimension (diameter). Consequently, the process precision of the ingot 1 is improved, compared with a cylindrical grinder A of a related art (a cylindrical grinding method of a related art).

Since the one end portion 1*a* side of the top portion 7 side of the ingot 1 is firmly supported on the lower support device 12 by the weight W1 of the ingot 1 itself, strong resistance is generated between the lower support device 12 and the one end portion 1*a* side of the ingot 1 by the weight of the ingot 1 itself. Therefore, even if a process load (pressing force) W2 of a transverse direction T1 acts on the ingot 1 from the grinding unit 11, one end portion 1*a* side of the ingot is not deviated.

Although the other end portion 1*b* side of the tail portion 8 side of the ingot 1 is held by the weak clamping force F1 applied from the upper support device 13, the clamping force F1 is set to a level to resist the process load W2 generated when the outer circumference of the other end portion 1*b* side of the ingot 1 is ground by the grinding unit 11, so that the other end portion 1*b* side of the ingot 1 is not deviated. Therefore, even though the clamping force F1 is set to be weak, the ingot 1 clampingly held by the pair of lower and upper support devices 12 and 13 is not deviated, thereby reliably improving the process precision of the ingot 1.

In addition, grinding dust falls down when the ingot 1 is ground by the grinding unit 11. The grinding dust enters into the engaging hole 15 formed in the holder 12*b* of the lower support device 12 through the large-diameter opening 15*a* of the top surface 12*c*, and thus the grinding dust may be stacked therein. In this respect, since the engaging hole 15 of the holder 12*b* of the lower support device 12 is formed to penetrate the holder from the top surface 12*c* to the bottom surface 12*d* in this embodiment, the grinding dust entering into the engaging hole 15 is discharged through the small-diameter opening 15*b* formed in the bottom surface 12*d* of the holder 12*b*. Consequently, the grinding dust is not stacked in the engaging hole 15, and thus it is not necessary to perform a process of removing the grinding dust from the engaging hole 15 when a next ingot 1 is cylindrically ground (i.e., it is not necessary to have a lot of manpower).

Figure 3:
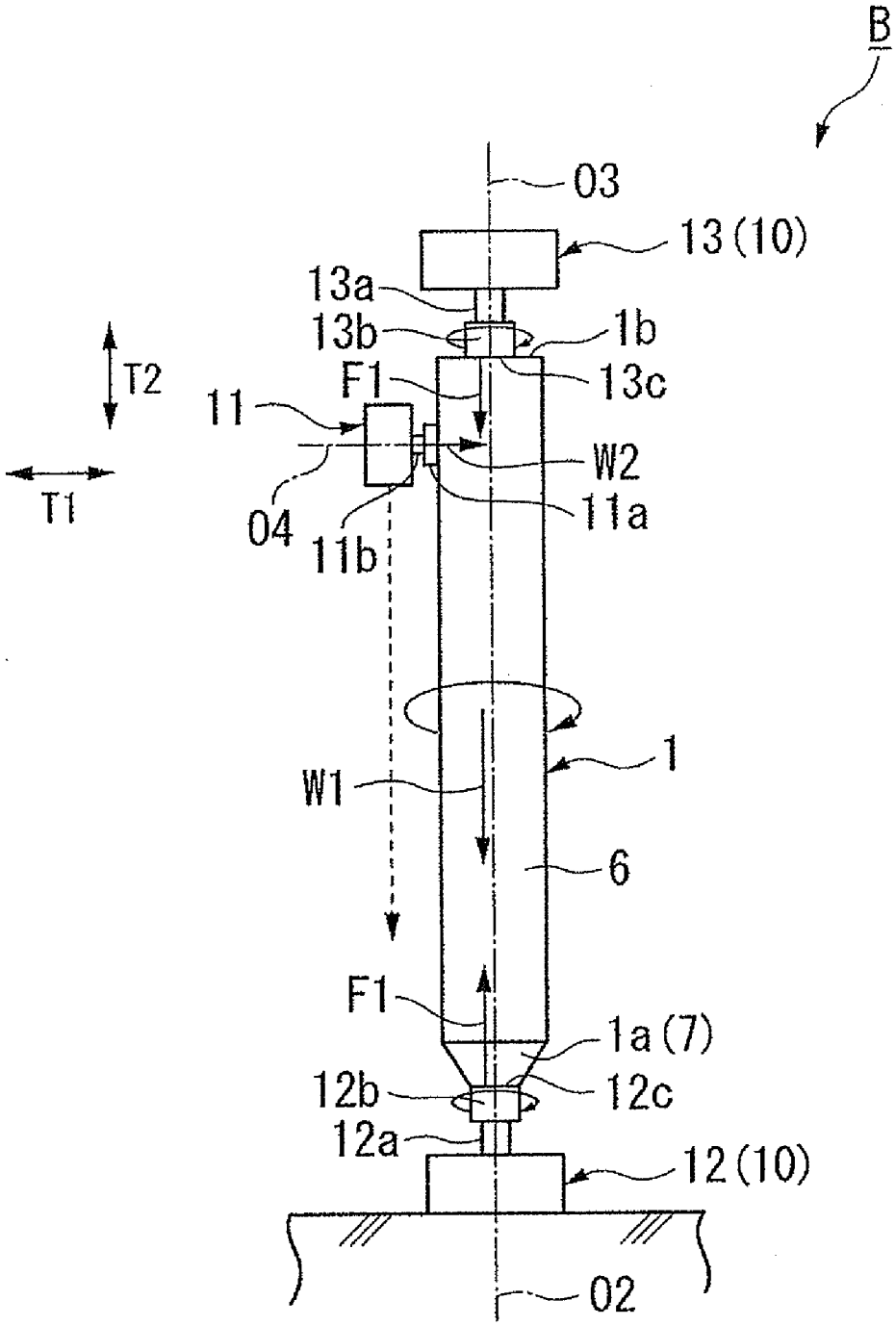
FIG. 3 is a front view illustrating a cylindrical grinder according to an embodiment of the invention to show a state in which an ingot with a cut tail portion (tail portion-cut product) is clampingly held.
Figure 4:
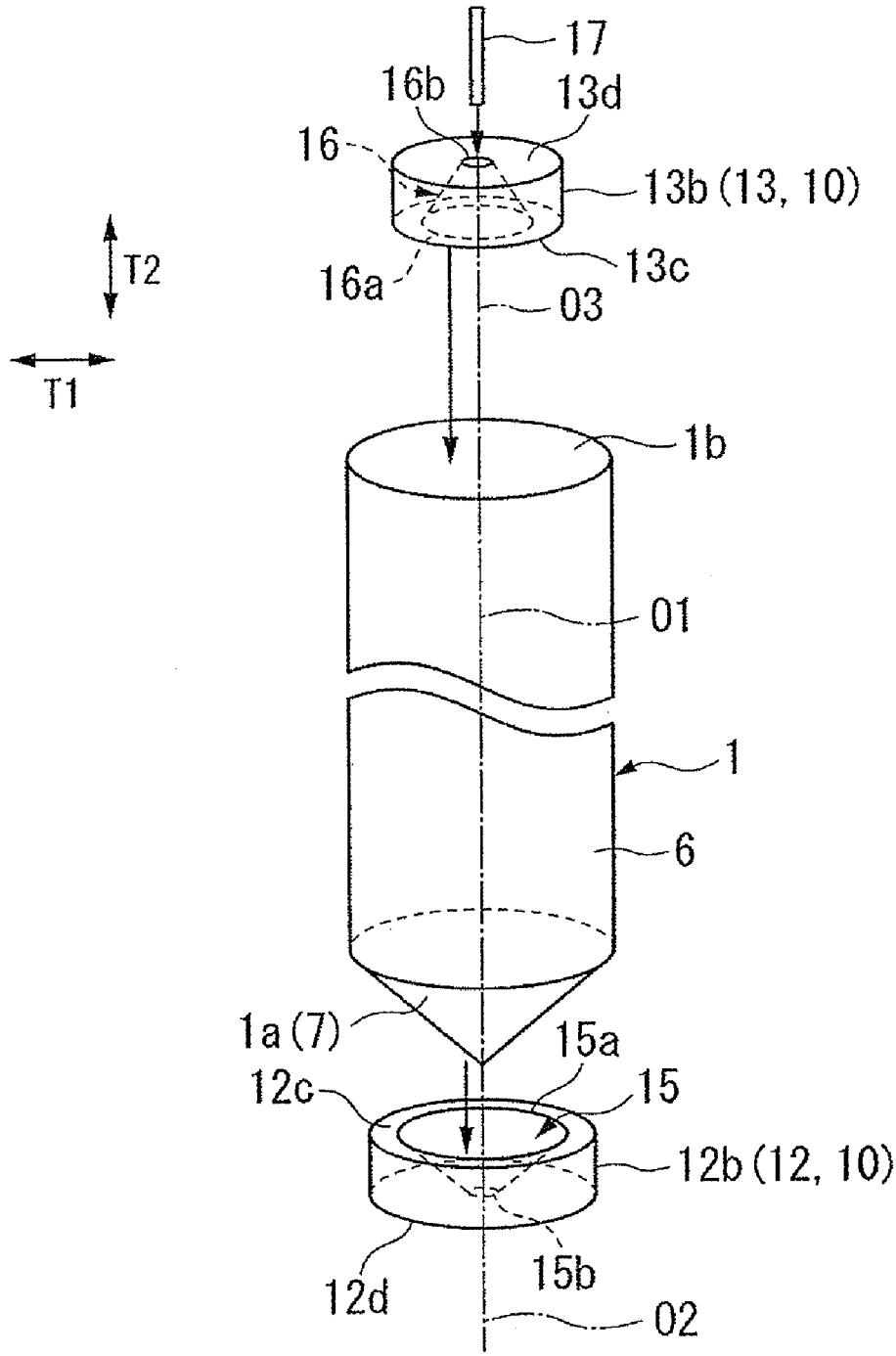
FIG. 4 is a perspective view illustrating a state in which a holder is mounted on an end portion of the ingot shown in FIG. 3.
Figure 5:
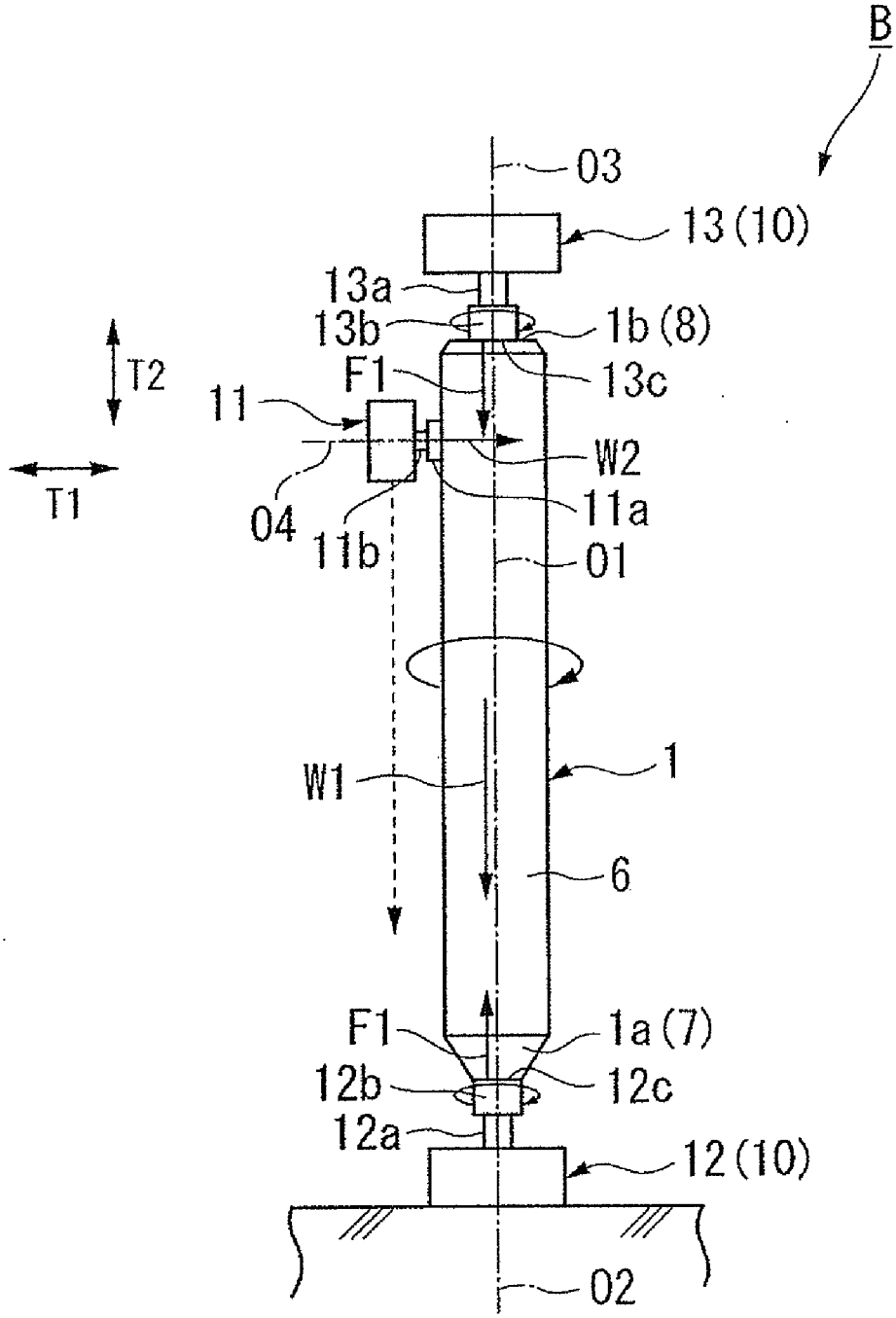
FIG. 5 is a front view illustrating a cylindrical grinder according to an embodiment of the invention to show a state in which the ingot (dislocation occurring product), of which a dislocation occurring portion of a tail portion is cut, is clampingly held.
Figure 6:
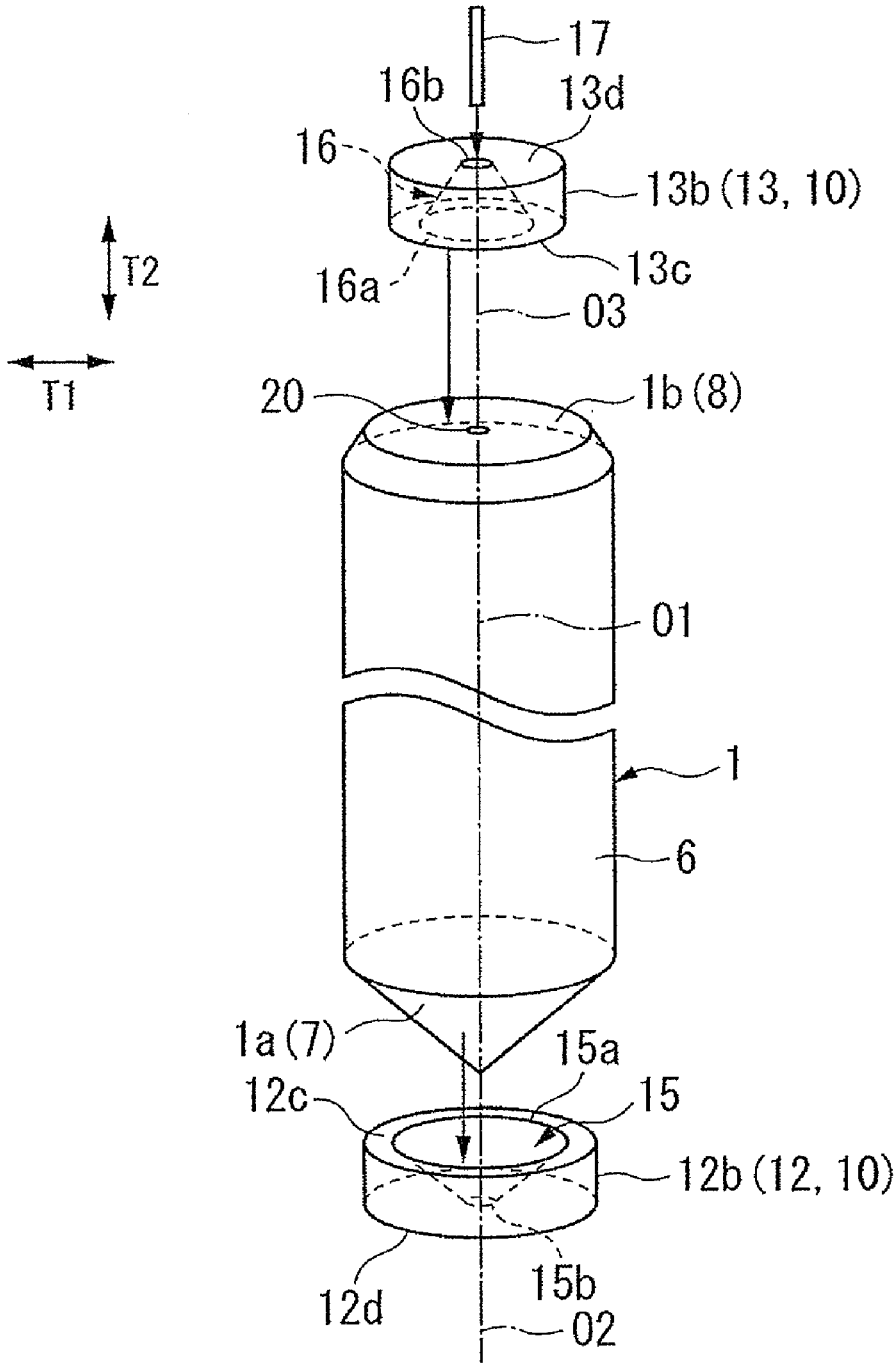
FIG. 6 is a perspective view illustrating a state in which a holder is mounted on an end portion of the ingot shown in FIG. 5.

As shown in FIGS. 3 and 4, when the ingot 1 with the cut tail portion 8 is cylindrically ground or, as shown in FIGS. 5 and 6, when the ingot 1 with the cut dislocation occurring portion of the tail portion 8 is cylindrically ground, since the top portion 7 is engaged to the engaging hole 15 of the lower support device 12, the axis line O1 of the ingot 1 and the central axis lines O2 and O3 of the support devices 12 and 13 are coaxially placed, so that the one end portion 1*a* side of the top portion 7 side of the ingot 1 is firmly held. If the holder 13*b* of the upper support device 13 moves downward, the bottom surface 13*c* of the holder 13*b* abuts on a cut surface (upper end face) of the other end portion 1*b* side of the ingot 1. The ingot 1 is applied with the weak clamping force F1 from the holder 13*b*, so that the other end portion 1*b* side of the ingot 1 is maintained so as not to be deviated. Consequently, the ingot can be cylindrically ground with high precision, similar to the ingot 1 with the top portion 7 and the tail portion 8.

Since the tail portion 8 side is cut with high precision so as to form the cut surface (upper end face) of the other end portion 1*b* of the ingot 1 in a plane shape perpendicular to the axis line O1, the holder 13*b* of the upper support device 13 moves downward to clampingly hold the ingot 1, and the axis line O1 of the ingot 1 and the central axis lines O2 and O3 of the support devices 12 and 13 are reliably and coaxially placed, so that the centering can be easily performed. In addition, as shown in FIG. 6, since a fitting hole 20 is formed on the upper end face (the other end portion 1*b*) at a position on the axis line O1 of the ingot 1 and then the leading end portion of the ingot sensing rod 17 is abutted on the fitting hole 20 and then the ingot 1 is clampingly held, the centering can be easily performed with high precision.

Figure 15:
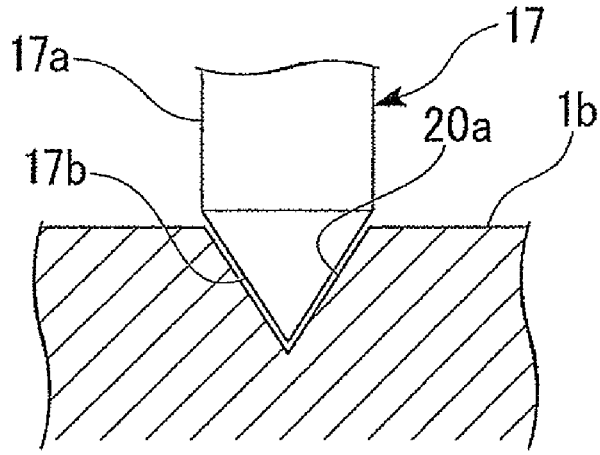
FIGS. 15 and 16 are longitudinal-sectional views illustrating a fitting structure of a sensing rod and a fitting hole.

There is no limit to the shape of the sensing rod 17. For example, the sensing rod 17 may be so thick that the straight barrel portion 17*a* penetrates the opening 16*b* of the holder 13*b*, and the leading end portion may be formed as the conical leading end portion 17*b* with a sharp leading end, as shown in FIG. 15. In this instance, the end portion 1*b* of the ingot is preferably provided with a conical fitting hole 20*a* with a shape complementary to the leading end portion 17*b*.

Figure 16:
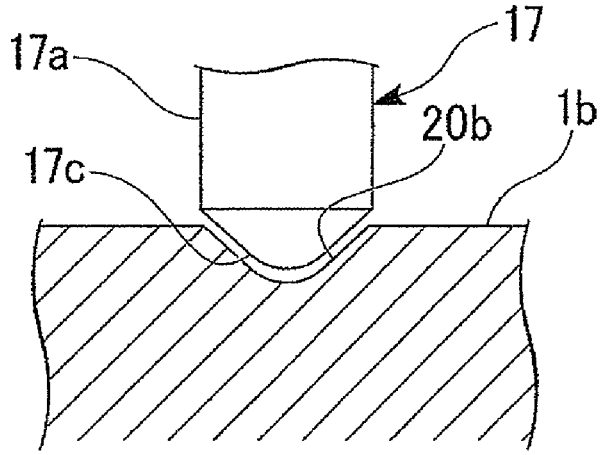

Otherwise, the sensing rod 17 may be provided with a convex round end portion 17*c*, as shown in FIG. 16. In this instance, the end portion 1*b* of the ingot is preferably provided with a fitting hole 20*b* of a concave round shape complementary to the end portion 17*c*.

As shown in FIGS. 7 and 8, when the ingot 1 with the cut top portion 7 and the cut tail portion 8 is cylindrically ground, the ingot 1 is set between the pair of lower and upper support devices 12 and 13 in the state in which the direction of the axis line O1 is disposed along the vertical direction T2, and the ingot 1 is placed on the holder 12*b* of the lower support device 12. In this instance, since the one end portion 1*a* side of the ingot 1 is not engaged to the engaging hole 15 of the holder 12*b* due to its cut top portion, that is, since the ingot 1 is placed while the lower end face (one end portion 1*a*) with the cut top portion 7 abuts on the upper surface 12*c* of the holder 12*b*, there is a case in which the ingot 1 is placed in the state in which the axis line O1 of the ingot 1 is deviated from the central axis line O2 of the lower support device 12. In this regard, with the cylindrical grinder B (cylindrical grinding method) of this embodiment, since the ingot 1 is set while the direction of the axis line O1 is disposed along the vertical direction T2, the axis line O1 of the ingot 1 and the central axis line O2 of the lower support device 12 are easily coaxially placed by placing the ingot 1 on the lower support device 12 and moving it in the transverse direction T1, thereby performing the centering. That is, it is not necessary to perform the centering by moving the ingot 1 in the vertical direction T2 and the back and forth direction T3, unlike the cylindrical grinder A of the related art.

The holder 13*b* of the upper support device 13 moves downward to clampingly hold the ingot 1 which has been subjected to the centering. In this instance, in the case in which the both end portions 1*a* and 1*b* of the ingot 1 with the cut top portion 7 and the cut tail portion 8 are not engaged to the engaging holes 15 and 16, the upper surface 12*c* of the holder 12*b* of the lower support device 12 comes in close contact with the one end portion 1*a* (the cut surface or the lower end face) of the ingot 1 by the weight of the ingot 1 itself, so that the one end portion 1*a* side of the ingot 1 is firmly held by the holder 12*b*. The lower surface 13*c* of the holder 13*b* of the upper support device 13 comes in close contact with the other end portion 1*b* (the cut surface or the upper end face) of the ingot 1, and the ingot 1 is applied with a weak clamping force F1 from the holder 13*b*, so that the other end portion 1*b* side of the ingot 1 can be firmly held. Consequently, similar to the ingot 1 with the top portion 7 and the tail portion 8, it is possible to cylindrically grind the ingot 1 with high precision without the occurrence of positional deviation.

The axis line O1 of the ingot 1 may be deviated when the ingot is clampingly held by the pair of lower and upper support devices 12 and 13, and in this instance, the correction of the centering can be easily performed by releasing the clampingly held state and moving the ingot 1 in the transverse direction T1.

Furthermore, as shown in FIG. 7, a positioning means 21 may be provided that can be moved back and forth in the transverse direction T1 by using, for example, a hydraulic cylinder. In this instance, at the step in which the ingot 1 is placed between the pair of lower and upper support devices 12 and 13 and then is placed on the holder 12*b* of the lower support device 12, the positioning means 21 is moved to press the ingot 1 in the transverse direction T1, so that the ingot 1 is moved to a predetermined position in which the axis line O1 of the ingot 1 and the central axis lines O2 and O3 of the support devices 12 and 13 are substantially coaxially placed. Therefore, it is possible to easily perform the centering by using the positioning means 21.

When the ingot 1 with the cut top portion 7 and the cut tail portion 8 is cylindrically ground, the ingot sensing rod 17 may be inserted into the holder 12*b* of the lower support device 12 through the small-diameter opening 15*b* from the bottom surface 12*d* side, as well as the holder 13*b* of the upper support device 13, and then the ingot sensing rod 17 may be mounted on the holder 12*b* of the lower support device 12. For example, similar to FIG. 6, the upper end face and the lower end face (the one end portion 1*a* and the other end portion 1*b*) of the ingot 1 with the cut top portion 7 and the cut tail portion 8 are provided with the fitting holes 20, and the leading end portion of the ingot sensing rod 17 may be abutted on the fitting hole 20, thereby easily performing the centering with high precision.

With the cylindrical grinder B and the cylindrical grinding method of the ingot 1 according to this embodiment, since the support unit 10 is adapted to clampingly hold the ingot 1 in the state in which the direction of the axis line O1 is disposed along the vertical direction T2, the acting direction of the weight W1 of the ingot 1 itself may be identical to the acting direction of the clamping force F1 by the support unit 10. For this reason, when the enlarged and weighted ingot 1 is cylindrically ground, the ingot 1 is not deformed by the weight W1, thereby enhancing the process precision, compared with the cylindrical grinder A of the related art (the cylindrical grinding method of the related art).

The lower end portion 1*a* side of the ingot 1 is firmly held on the lower support device 12 by its weight W1 of the ingot 1 to prevent the positional deviation of the lower end portion 1*a* side. Further, the ingot 1 is applied with the weak clamping force F1 from the upper support device 13, which can resist the process load W2 of the transverse direction T1 from the grinding unit 11, thereby preventing the positional deviation of the upper end portion 1*b* side. Therefore, even if the clamping force F1 is set to be weak, the positional deviation does not occur between the pair of lower and upper support devices 12 and 13 and the ingot 1, thereby reliably improving the process precision.

In addition, when the ingot 1 is placed between the pair of lower and upper support devices 12 and 13 and then is clampingly held, it is possible to perform the centering by moving the ingot 1 placed on the lower support device 12 in the transverse direction T1. Consequently, unlike the cylindrical grinder A of the related art which clampingly holds the ingot 1 in the state in which the direction of the axis line O1 is disposed along the horizontal direction T1, since it is not necessary to perform the centering (or the correction of the centering) by moving the ingot 1 in the vertical direction T2 or the back and forth direction T3, the centering can be easily performed.

If the ingot 1 is pressed in the transverse direction T1 by the positioning means 21, it is possible to move the ingot 1 to a predetermined position in which the axis line O1 of the ingot 1 and the central axis lines O2 and O3 of the support devices 12 and 13 are substantially coaxially placed. Therefore, the centering can be easily performed by the positioning means 21.

With the cylindrical grinder B and the cylindrical grinding method of the ingot 1 according to this embodiment, the holders 12*b* and 13*b* are provided with the conical engaging holes 15 and 16, and the top portion 7 and the tail portion 8 are engaged to the engaging holes 15 and 16, so that the end portions 1*a* and 1*b* side of the ingot 1 can be easily and reliably held without the occurrence of positional deviation. Since the axis line O1 of the ingot 1 and the central axis lines O2 and O3 of the support devices 12 and 13 are automatically coaxially placed by allowing the top portion 7 and the tail portion 8 to engage to the engaging holes 15 and 16, the centering can be easily performed.

Since the engaging hole 15 of the holder 12*b* of the lower support device 12 is formed to penetrate the holder from the top surface 12*c* to the bottom surface 12*d*, if the grinding dust generated when the outer circumference of the ingot 1 is ground enters into the engaging hole 15 of the holder 12*b*, it is possible to discharge the grinding dust outwardly from the opening 15*b* of the bottom surface 12*d*. Since the engaging hole 16 formed in the holder 13*b* of the upper support device 13 is formed to penetrate the holder from the bottom surface 13*c* to the top surface 13*d*, the ingot sensing rod 17 can be inserted and mounted into the engaging hole 16. For this reason, when the upper end portion 1*b* side of the ingot 1 is clampingly held by moving the holder 13*b*, the ingot 1 can be sensed by the ingot sensing rod 17. Therefore, it is possible to clampingly hold the ingot 1 appropriately by applying the predetermined clamping force F1 to the ingot so as not to occur positional deviation.

Since the top portion 7 side of the ingot 1 is placed at a lower position, and the ingot 1 is clampingly held by the support unit 10, it is possible to clampingly hold the ingot 1 by applying strong compressive force to the top portion 7 side due to the weight W1 of the ingot 1 itself and applying weak clamping force F1 on the tail portion 8 side. Therefore, it is possible to clampingly hold the ingot 1 appropriately by reliably preventing the tail portion 8 side from being damaged. As a result, it is possible to perform the cylindrical grinding without cutting the dislocation occurring portion of the tail portion 8 prior to the cylindrical grinding.

As in this embodiment, if the ingot 1 is clampingly held in the state in which the direction of the axis line O1 is disposed along the vertical direction T2, a large bending moment does not act on the main shaft 12*a* and the auxiliary shaft 13*a* of the pair of lower and upper support devices 12 and 13, compared with the cylindrical grinder A of the related art. For this reason, there is no risk of deforming the main shaft 12*a* and the auxiliary shaft 13*a*.

In addition, if the ingot 1 is clampingly held in the state in which the direction of the axis line O1 is disposed along the vertical direction T2, it is possible to reduce an occupied area, such as the floor surface, required for installation of the cylindrical grinder B, compared with the cylindrical grinder A of the related art in which the ingot 1 is clampingly held in the state in which the direction of the axis line O1 is disposed along the horizontal direction T1. Therefore, it is possible to promote space saving.

Although the cylindrical grinder and the cylindrical grinding method of the ingot according to the embodiment of the invention are described above, the invention is not limited thereto, and can be properly changed without deviating from the scope of the invention. For example, although the grinding unit 11 traverse grinds the outer circumference of the ingot 1 while moving in the vertical direction T2 along the direction of the axis line O1 of the ingot 1 which is clampingly held by the support unit 10, the grinding unit 11 and the ingot 1 may be relatively moved along the direction of the axis line O1. The ingot 1 may be traverse ground while the ingot 1 is moved in the vertical direction T2 with respect to the grinding unit 11.

Although the holders 12*b* and 13*b* are respectively fixed to the leading end portion of the main shaft 12*a* of the driving shaft and the auxiliary shaft 13*a* of the driven shaft to form the pair of lower and upper support devices 12 and 13 and the support unit 10, for example, the holder 12*b* may be rotated around the central axis line O2 by rotating a power transmission member, such as belt or chain, wound around an outer circumference of the holder 12*b*. There is no special limit to the mechanism for rotating the holder 12*b* (the holder 13*b*) and the ingot 1.

While preferred embodiments of the invention have been described and illustrated above, it should be understood that these are exemplary of the invention and are not to be considered as limiting. Additions, omissions, substitutions, and other modifications can be made without departing from the spirit or scope of the present invention. Accordingly, the invention is not to be considered as being limited by the foregoing description, and is only limited by the scope of the appended claims.

What is claimed is:

1. A cylindrical grinder, comprising:

a support assembly including an upper support and a lower support, in which an ingot of silicon single crystal is interposed in a direction of an axis line of the ingot between the upper support and the lower support and is clampingly held to be rotated around the axis line of the ingot;

a grinder that relatively moves along the direction of axis line of the ingot to traverse grind an outer circumference of the ingot, wherein the upper support is placed at an upper position and the lower support is placed at a lower position, so that the support assembly clampingly holds the ingot in a state in which the direction of the axis line of the ingot is disposed along a vertical direction; and a positioner configured to position the ingot at a predetermined position by pressing the ingot, which is interposed between the upper support and the lower support, in a horizontal direction.

2. The cylindrical grinder according to claim 1, wherein each of the upper support and the lower support includes a holder for holding an end portion side of the ingot in the direction of the axis line of the ingot, and the holder is provided with a conical engaging hole with a diameter which is gradually decreased from one surface facing the ingot side to the other surface with a central axis of the holder as a center.

3. The cylindrical grinder according to claim 2, wherein the engaging hole is formed to penetrate the holder from the one surface to the other surface.

4. The cylindrical grinder according to claim 3, wherein the lower support includes a holder for holding a conical top portion of the ingot, and the upper support includes a holder for holding a conical tail portion of the ingot.

5. The cylindrical grinder according to claim 3, further comprising an ingot sensing rod capable of being abutted on an end portion of the ingot through the engaging hole of the holder.

6. The cylindrical grinder according to claim 3, wherein the holder has a circular flat surface configured to support a cut surface of the ingot of which at least one of the top portion and the tail portion is cut.

7. A cylindrical grinding method of an ingot comprising:

interposing and holding both end portions of an ingot of silicon single crystal in a state in which a direction of an axis line of the ingot is disposed along a vertical direction between an upper support and a lower support of a support assembly; and rotating the ingot around the axis line of the ingot together with the upper support and the lower support, and moving a grinder along the direction of the axis line of the ingot to traverse grind an outer circumference of the ingot, wherein a top portion side of the ingot which is initially formed when the ingot is produced by growing the silicon single crystal is placed at the lower support, and the ingot is clampingly held by the support assembly.

8. The cylindrical grinding method according to claim 7, further comprising:

cutting at least one of a top portion and a tail portion of the ingot in a direction perpendicular to the axis line of the ingot; and interposing and holding both end portions of the ingot by the upper support and the lower support.

9. The cylindrical grinding method according to claim 8, further comprising:

forming a fitting hole at a center of a cut surface of the ingot; and fitting a leading end portion of a sensing rod placed along an axis line of at least one of the upper support and the lower support into the fitting hole to position the ingot.

* * * * *